US007541727B2

(12) United States Patent
Kang

(10) Patent No.: US 7,541,727 B2
(45) Date of Patent: Jun. 2, 2009

(54) SHADOW MASK FOR CATHODE RAY TUBE HAVING PREDETERMINED RADIUS OF CURVATURE

(75) Inventor: Sang Hyung Kang, Kumi-si (KR)

(73) Assignee: LG. Philips Displays Korea Co., Ltd., Kumi-si, Kyungsangbuk-Do (KR)

( * ) Notice: Subject to any disclaimer, the term of this patent is extended or adjusted under 35 U.S.C. 154(b) by 505 days.

(21) Appl. No.: 11/359,520

(22) Filed: Feb. 23, 2006

(65) Prior Publication Data

US 2006/0197430 A1 Sep. 7, 2006

(30) Foreign Application Priority Data

Feb. 24, 2005 (KR) ..... 10-2005-0015355

(51) Int. Cl.
*H01J 29/81* (2006.01)
*H01J 29/07* (2006.01)

(52) U.S. Cl. ..... 313/402; 313/407; 313/408

(58) Field of Classification Search ..... 313/402–408
See application file for complete search history.

(56) References Cited

U.S. PATENT DOCUMENTS 4,881,004 A * 11/1989 Inoue et al. ..... 313/408
5,247,224 A * 9/1993 Bae ..... 313/404
5,416,379 A * 5/1995 Inoue et al. ..... 313/402
5,631,520 A * 5/1997 Inoue et al. ..... 313/402
6,472,805 B1 * 10/2002 Nakagawa et al. ..... 313/402
6,650,036 B2 * 11/2003 Nakagawa et al. ..... 313/402

FOREIGN PATENT DOCUMENTS

CN 1031624 A 3/1989

* cited by examiner

*Primary Examiner*—Mariceli Santiago
(74) *Attorney, Agent, or Firm*—Birch, Stewart, Kolasch & Birch, LLP

(57) ABSTRACT

A cathode ray tube is disclosed, in which a shadow mask satisfies the following condition: Rx<1200 mm or Ry<1200 mm, and further satisfies the following condition: 0<Rd<3000 mm or Rd <−1500. The structural strength of the shadow mask is increased, thereby greatly improving thermal distortion and vibration problems of the shadow mask as well as greatly improving the qualities such as the drop characteristic, doming characteristic and inner pin distortion problem.

18 Claims, 2 Drawing Sheets

SHADOW MASK FOR CATHODE RAY TUBE HAVING PREDETERMINED RADIUS OF CURVATURE

BACKGROUND OF THE INVENTION

1. Field of the Invention

The present invention relates to a cathode ray tube which optimizes a radius of curvature in the directions of a long axis, a short axis and a diagonal axis of a shadow mask as the deflection angle of an electron beam is increased.

2. Description of the Background Art

FIG. 1 is a sectional view illustrating an internal structure of a general cathode ray tube.

In general, a cathode ray tube comprises a vacuum envelope 1 having a panel 2 and a funnel 4 coupled to each other.

In the vacuum envelope 1, included are a screen 3 having a plurality of phosphors coated thereon, an electron gun (not shown) for emitting an electron beam to make the phosphors give off light by hitting the phosphors of the screen 3, and a shadow mask 6 for discriminating the electron beam in colors so that the electron beam emitted toward the screen 3 from the electron gun can hit the phosphors of the screen 3.

The shadow mask 6 includes a plurality of electron beam through holes formed in the effective area through which an electron beam passes.

Besides, on the outer side of the vacuum envelope 1, included is a deflection yoke 8 for deflecting the electron beam vertically and horizontally so that the electron beam emitted toward the screen 3 from the electron gun can reach the screen 3 through any one of the plurality of electron beam through holes formed on the shadow mask 6.

In the thus-constructed cathode ray tube, the electron beam emitted from the electron gun is horizontally and vertically deflected by the deflection yoke 8 to advance, and reaches the screen 3 through the electron beam through holes of the shadow mask 6, whereby the phosphors coated on the screen 3 give off light by the electron beam that has reached the screen 3 to realize an image.

Meanwhile, in recent years, cathode ray tubes have become larger, flatter and slimmer as the strategies for acquiring a competitive edge over other display manes such as LCDs and PDPs. Especially, the cathode ray tube inevitably has a more disadvantageous structure compared to the other display means in terms of getting slimmer due to the characteristics of products that achieve a screen image by projecting an electron beam.

In other words, in order for the cathode ray tube to become larger and flatter, the deflection angle of the electron beam has to be increased as compared to the conventional art. The increase of the deflection angel of the electron beam means that the radius of curvature of the inner surface of the panel 2 needs to become flatter and accordingly, the shadow mask 6 needs to be flatter too.

However, if the shadow mask 6 becomes flatter, the structural strength of the shadow mask 6 becomes weaker, which leads to a problem that thermal distortion, vibration characteristics and drop characteristics are greatly deteriorated. Thus, a design for optimizing the radius of curvature of the shadow mask 6 is required.

Further, if the radius of curvature of the end of an effective surface of the shadow mask 6 is small, the structural strength of the shadow mask 6 can be enhanced, while an inner pin distortion occurs in which a screen image appears to be bent inward of the screen 3 as seen in the region indicated by 'A' in FIG. 2. The inner pin distortion becomes more serious when the radius of curvature of the shadow mask 6 sharply decreases toward the peripheral portions of the shadow mask. Therefore, a design for optimizing the radius of curvature of the shadow mask 6 considering the aforementioned inner pin distortion is required.

That is to say, if the radius of curvature of the end of the effective area of the shadow mask 6 is decreased, the structural strength of the shadow mask 6 can be improved but a screen distortion caused by the inner pin distortion gets worse.

Moreover, if the shadow mask 6 is formed with a single radius of curvature so that it becomes flat, the screen distortion caused by the inner pin distortion is improved, but a thermal distortion occurs due to a decrease of the structural strength of the shadow mask 6 and as a result, problems caused by doming and vibration characteristics are generated.

SUMMARY OF THE INVENTION

The present invention is directed to overcome the conventional problems, and an object of the present invention is to provide a cathode ray tube which optimizes a radius of curvature of the end in the directions of a long axis, a short axis and a diagonal axis of an effective surface of a shadow mask by considering the structural strength and inner pin distortion of the shadow mask as the deflection angle of an electron beam is increased.

To accomplish the above object, there is provided a cathode ray tube in accordance with the present invention, which comprises a shadow mask between an electron gun and a screen and, which has a deflection angle of 120 degrees of an electron beam directed toward a screen from the electron gun, wherein the shadow mask satisfies the following condition: $Ry<1200$ mm where Ry is a radius of curvature of the end in the direction of a short axis of an effective surface of the shadow mask.

The shadow mask satisfies the following condition: $Ry<1000$ mm.

The shadow mask satisfies the following condition: $Rx<1200$ mm where Rx is a radius of curvature of the end in the direction of a long axis of an effective surface of the shadow mask.

The shadow mask satisfies the following condition: $Rx<1000$ mm.

The shadow mask satisfies the following condition: $0<Rd<3000$ mm where Rd is a radius of curvature of the end in the direction of a diagonal axis of an effective surface of the shadow mask.

The shadow mask satisfies the following condition: $Rd<-1500$ mm where Rd is a radius of curvature of the end in the direction of a diagonal axis of an effective surface of the shadow mask.

The shadow mask satisfies the following condition: $Rx>1200$ mm and the following condition: $0<Rd<3000$ mm or $Rd<-1500$ where Rx is a radius of curvature of the end in the direction of a long axis of an effective surface of the shadow mask and Rd is a radius of curvature of the end in the direction of a diagonal axis of an effective surface of the shadow mask.

The shadow mask satisfies the following condition: $Ry<1000$ mm and $Rx<1200$ mm and the following condition: $0<Rd<3000$ mm or $Rd<-1500$ mm where Rx is a radius of curvature of the end in the direction of a long axis of an effective surface of the shadow mask and Rd is a radius of curvature of the end in the direction of a diagonal axis of an effective surface of the shadow mask.

To accomplish the above object, according to another aspect of the present invention, there is provided a cathode ray tube in accordance with the present invention, which comprises a shadow mask between an electron gun and a screen and, which has a deflection angle of 120 degrees of an electron beam directed toward a screen from the electron gun, wherein the shadow mask satisfies the following condition: Rx<1200 mm where Rx is a radius of curvature of the end in the direction of a long axis of an effective surface of the shadow mask.

The shadow mask satisfies the following condition: Ry<1000 mm where Ry is a radius of curvature of the end in the direction of a short axis of an effective surface of the shadow mask.

The shadow mask satisfies the following condition: 0<Rd<3000 mm or Rd<−1500 mm where Rd is a radius of curvature of the end in the direction of a diagonal axis of an effective surface of the shadow mask.

To accomplish the above object, according to yet another aspect, there is provided a cathode ray tube in accordance with the present invention, which comprises a panel whose outer surface is substantially flat and whose inner surface has a predetermined curvature; a funnel coupled with the panel; an electron gun inserted into the funnel, for discharging an electron beam toward a screen; and a shadow mask disposed between the electron gun and the screen, wherein the shadow mask satisfies the following condition: Ry<1200 mm where Ry is a radius of curvature of the end in the direction of a short axis of an effective surface of the shadow mask.

The shadow mask satisfies the following condition: Ry<1000 mm.

The shadow mask satisfies the following condition: Rx<1200 mm where Rx is a radius of curvature of the end in the direction of a long axis of an effective surface of the shadow mask.

The shadow mask satisfies the following condition: Rx<1000 mm.

The shadow mask satisfies the following condition: 0<Rd<3000 mm or Rd<−1500 mm where Rd is a radius of curvature of the end in the direction of a diagonal axis of an effective surface of the shadow mask.

The cathode ray tube has a deflection angle of 120 degrees of the electron beam.

To accomplish the above object, according to still another aspect, there is provided a cathode ray tube in accordance with the present invention, which comprises a panel whose outer surface is substantially flat and whose inner surface has a predetermined curvature; a funnel coupled with the panel; an electron gun inserted into the funnel, for discharging an electron beam toward a screen; and a shadow mask disposed between the electron gun and the screen, wherein the shadow mask satisfies the following condition: Rx<1200 mm where Rx is a radius of curvature of the end in the direction of a short axis of an effective surface of the shadow mask.

The shadow mask satisfies the following condition: Rx<1000 mm.

The cathode ray tube has a deflection angle of 120 degrees of the electron beam.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Hereinafter, an embodiment of a cathode ray tube in accordance with the present invention will be described with reference to the accompanying drawings.

There may exist a plurality of embodiments of a cathode ray tube in accordance with the present invention, and the most preferred embodiment will be explained. However, the basic structure of the cathode ray tube is the same as that of the conventional art as that of the conventional art described previously, and a detailed description thereof will be omitted.

Figure 1:
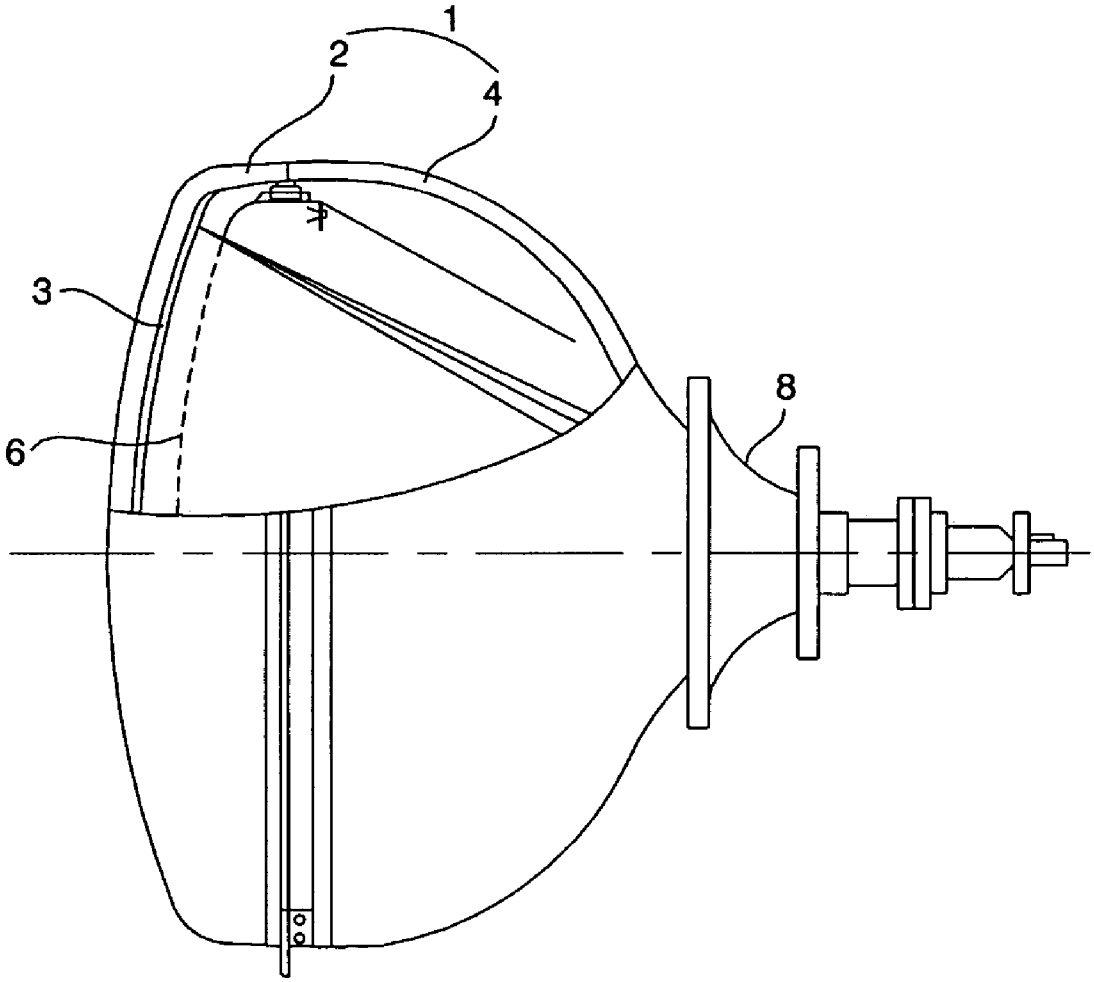
Fig. 1 (prior art)
FIG. 1 is a sectional view illustrating an internal structure of a general cathode ray tube.
Figure 2:
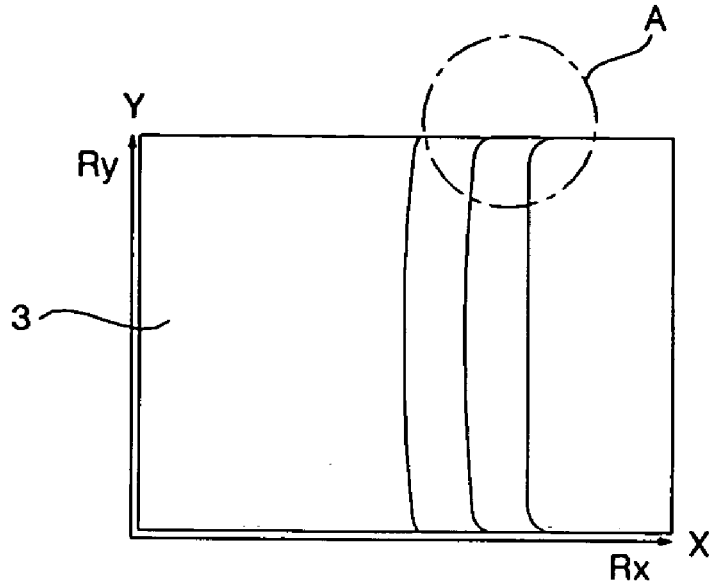
Fig. 2 (prior art)
FIG. 2 is a view illustrating a screen distortion caused by an inner pin distortion in a cathode ray tube in accordance with the conventional art.
Figure 3:
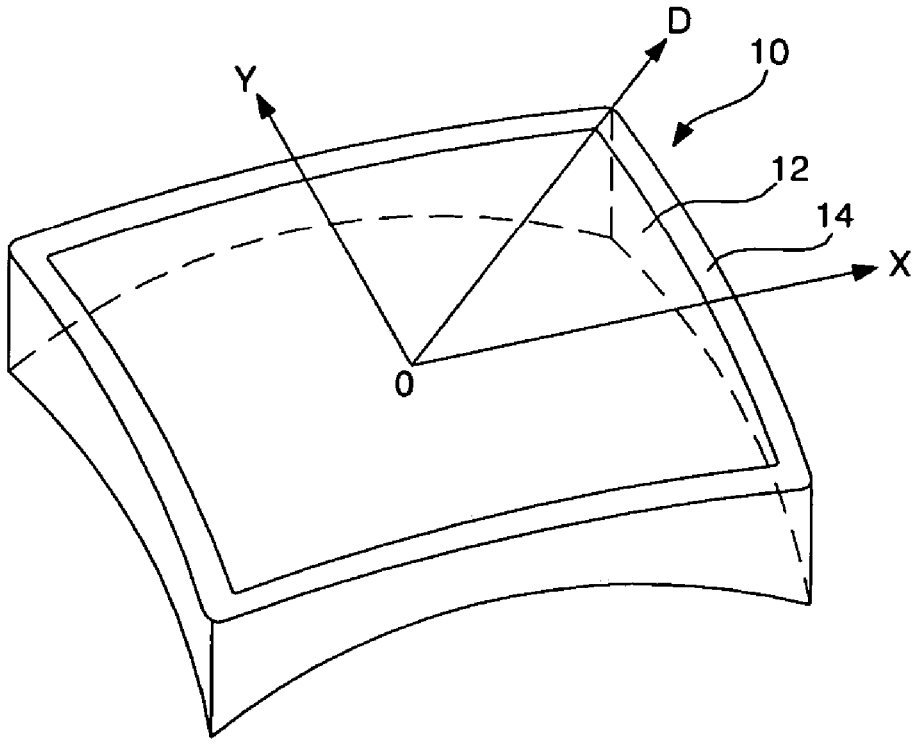
FIG. 3 is a view illustrating a radius of curvature of a shadow mask in a cathode ray tube in accordance with the present invention.

FIG. 3 is a view illustrating a radius of curvature of a shadow mask in a cathode ray tube in accordance with the present invention.

The cathode ray tube in accordance with the present invention comprises a shadow mask 10 disposed between an electron gun and a screen, for discriminating an electron beam emitted from the electron gun toward the screen in colors, and is constructed such that the deflection angle of the electron beam is more than 120 degrees in order to have a wide angle.

The shadow mask 10 can be divided into an effective surface 12 having a plurality of electron beam through holes formed so as to serve to discriminate an electron beam emitted from the electron gun toward the screen and a skirt portion 14 formed on an outer side of the effective surface 12 of the shadow mask 10.

When viewed from a plane, among horizontal and vertical sides of the shadow mask 10, the direction of the relatively longer side is defined as a long axis direction X of the shadow mask 10 and the direction of the relatively shorter side is defined as a short axis direction Y of the shadow mask 10, and the direction linking the center of the shadow mask 10 and the point where the horizontal and vertical sides of the shadow mask 10 meet is defined as a diagonal axis direction D.

And, a radius of curvature of the end in the direction of a long axis of the effective surface 12 of the shadow mask 10 is defined as Rx, a radius of curvature of the end in the direction of a short axis of the effective surface 12 of the shadow mask 10 is defined as Ry, and a radius of curvature of the end in the direction of a diagonal axis of the effective surface 12 of the shadow mask 10 is defined as Rd, The radii of curvature of the respective axes of the shadow mask 10 have to be optimally designed according to the deflection angle of the electron beam as stated in the following Tables 1 to 6 so as to ensure good quality of the drop characteristic, doming characteristic and inner pin distortion.

TABLE 1

| Model | Rx (mm) | Ry (mm) | Rd (mm) | Drop (g) | Doming (μm) | Inner pin (mm) |
|---|---|---|---|---|---|---|
| 28_1 | 1063 | 1350 | −2568 | 20 | 29 | 1.2 |
| 28_2 | 2276 | 1528 | 2816 | 20 | 30 | 1 |
| 28_3 | 3066 | 1748 | 5460 | 33 | 33 | 1.1 |
| 29_1 | 2981 | 1624 | −4845 | 22 | 22 | 1.3 |
| 32_1 | 2996 | 4572 | 6436 | 28 | 28 | 1.1 |
| 32_2 | 4671 | 1525 | 4270 | 28 | 28 | 1.5 |
| 32_3 | 5323 | 730 | 6607 | 33 | 33 | 1.3 |
| 32_4 | 441 | 1493 | −683 | 29 | 29 | 1.5 |

Table 1 shows the drop characteristic, doming characteristic and inner pin distortion according to radii of curvature Rx, Ry and Rd of the respective axes of the shadow mask 10 in a cathode ray tube having a deflection angle of the electron beam of 90 to 110 degrees and a size of 28 to 32 inches.

Through Table 1, it can be seen that the cathode ray tube having a deflection angle of the electron beam of 90 to 110 degrees and a size of 28 to 32 inches has no big problem in the drop characteristic, doming characteristic and inner pin distortion according to radii of curvature Rx, Ry and Rd of the respective axes of the shadow mask 10.

TABLE 2

| Deflection angle (°) | Model | Rx (mm) | Rd (mm) | Ry (mm) | Drop (g) | Doming (μm) | Inner pin (mm) |
|---|---|---|---|---|---|---|---|
| 119 | 28 | 1000 | 1500 | 1200 | 18.2 | 28 | 2.1 |
| 120 | 29 | 1100 | 1500 | 1200 | 17.7 | 30 | 2.5 |
| 120 | 29 | 1205 | 1500 | 1200 | 17.5 | 35 | 2.7 |
| 120 | 29 | 1300 | 1500 | 1200 | 15.9 | 40 | 3.1 |
| 120 | 29 | 1400 | 1500 | 1200 | 15.4 | 47 | 3.3 |

Table 2 shows the drop characteristic, doming characteristic and inner pin distortion when the shadow mask 10 satisfies the following condition: Ry is 1200 mm, Rd is 1500 mm and Rx is 1000 to 1400 mm, in a cathode ray tube having a deflection angle of the electron beam of approximately 120 degrees and a size of 28 to 29 inches.

Through Table 2, it can be seen that as the angle of the cathode ray tube increases, when the shadow mask 10 satisfies the following condition: Rx<1200, the drop characteristic, doming characteristic and inner pin distortion are good. More preferably, the shadow mask 10 satisfies the following condition: Rx<1000 mm.

TABLE 3

| Deflection angle (°) | Model | Rx (mm) | Rd (mm) | Ry (mm) | Drop (g) | Doming (μm) | Inner pin (mm) |
|---|---|---|---|---|---|---|---|
| 119 | 28 | 1200 | 1500 | 1000 | 18.1 | 28 | 2.1 |
| 120 | 29 | 1200 | 1500 | 1105 | 17.6 | 30 | 2.3 |
| 120 | 29 | 1200 | 1500 | 1200 | 17.5 | 35 | 2.7 |
| 120 | 29 | 1200 | 1500 | 1320 | 15.8 | 41 | 3.1 |
| 120 | 29 | 1200 | 1500 | 1400 | 15.1 | 48 | 3.6 |

Table 3 shows the drop characteristic, doming characteristic and inner pin distortion when the shadow mask 10 satisfies the following condition: Rx is 1200 mm, Rd is 1500 mm and Ry is 1000 to 1400 mm, in a cathode ray tube having a deflection angle of the electron beam of approximately 120 degrees and a size of 28 to 29 inches.

Through Table 3, it can be seen that as the angle of the cathode ray tube increases, when the shadow mask 10 satisfies the following condition: Ry<1200, the drop characteristic, doming characteristic and inner pin distortion are good. More preferably, the shadow mask 10 satisfies the following condition: Ry<1000 mm.

TABLE 4

| Deflection angle (°) | Model | Rx (mm) | Rd (mm) | Ry (mm) | Drop (g) | Doming (μm) | Inner pin (mm) |
|---|---|---|---|---|---|---|---|
| 119 | 28 | 1200 | 1300 | 1200 | 18.0 | 30 | 2.2 |
| 120 | 29 | 1200 | 1400 | 1200 | 17.8 | 32 | 2.6 |
| 120 | 29 | 1200 | 1500 | 1200 | 17.5 | 35 | 2.7 |
| 120 | 29 | 1200 | 1600 | 1200 | 16.3 | 42 | 3.3 |
| 120 | 29 | 1200 | 1700 | 1200 | 15.8 | 45 | 3.4 |

Table 4 shows the drop characteristic, doming characteristic and inner pin distortion when the shadow mask 10 satisfies the following condition: Rx is 1200 mm, Ry is 1200 mm and Rd is 1300 to 1700 mm, in a cathode ray tube having a deflection angle of the electron beam of approximately 120 degrees and a size of 28 to 29 inches.

Through Table 4, it can be seen that as the angle of the cathode ray tube increases, the smaller the Rd value of the shadow mask 10, the better the drop characteristic, doming characteristic and inner pin distortion. More preferably, the shadow mask 10 satisfies the following condition: Ry<1500 mm.

TABLE 5

| Deflection angle (°) | Rx (mm) | Ry (mm) | Rd (mm) | Drop (g) | Doming (μm) | Inner pin (mm) |
|---|---|---|---|---|---|---|
| 120 | 509 | 508 | 2650 | 19 | 30 | 1.2 |
| | 978.4 | 598.0 | 1295.4 | 18 | 31 | 1.5 |
| | 409 | 809 | 1280 | 20 | 31 | 1.5 |
| | 986.3 | 970.0 | −1578.7 | 21 | 32 | 2.3 |
| | 100 | 1030 | −1500 | 21 | 32 | 2.9 |
| | 1205 | 1220 | 2310 | 17.5 | 35 | 2.8 |
| | 1320 | 2490 | 2500 | 16.5 | 41 | 3.1 |

Table 5 shows the drop characteristic, doming characteristic and inner pin distortion according to radii of curvature Rx, Ry and Rd of the respective axes of the shadow mask 10 in a cathode ray tube having a deflection angle of the electron beam of 120 degrees and a size of 29 and 32 inches.

Through Table 5, it can be seen that as the angle of the cathode ray tube increases, when the shadow mask 10 satisfies the following condition: Rx<1200 mm and Ry<1200 mm, the drop characteristic, doming characteristics and inner pin distortion are good. More preferably, the shadow mask 10 is constructed to satisfy the following condition: Rx<1000 mm and Ry<1000 mm, so that the quality of the cathode ray tube as well as the strength of the shadow mask 10 can be enhanced.

Moreover, the curvature of the shadow mask 10 can be easily obtained when Rd satisfies a predetermined range in association with Rx and Ry. Thus, it is necessary to set Rd to an appropriate range. Therefore, it is preferred that the shadow mask 10 satisfies the following condition: 0<Rd<3000 mm or the following condition: Rd<−15 mm.

TABLE 6

| Deflection angle (°) | Rx (mm) | Ry (mm) | Rd (mm) | Drop (g) | Doming (μm) | Inner pin (mm) |
|---|---|---|---|---|---|---|
| 125 | 876.6 | 207.7 | 3440 | 17 | 40 | 2.5 |
| | 750 | 509 | 1850 | 18.2 | 43 | 2.2 |
| | 380 | 680 | 3520 | 17.2 | 41 | 1.9 |
| | 489 | 789 | 2100 | 17 | 43 | 2 |
| | 1020 | 1180 | −1580 | 17 | 46 | 3 |
| | 1230 | 1520 | 3210 | 16.3 | 52 | 3.2 |

Table 6 shows the drop characteristic, doming characteristic and inner pin distortion according to radii of curvature Rx, Ry and Rd of the respective axes of the shadow mask 10 in a cathode ray tube having a deflection angle of the electron beam of 125 degrees and a size of 32 inches.

Through Table 6, it can be seen that as the angle of the cathode ray tube increases, when the shadow mask 10 satisfies the following condition: Rx<1200 mm and Ry<1200 mm, the drop characteristic, doming characteristics and inner pin distortion are good. More preferably, the shadow mask 10 is constructed to satisfy the following condition: Rx<1000 mm and Ry<1000 mm, so that the quality of the cathode ray tube as well as the strength of the shadow mask 10 can be enhanced.

Moreover, the curvature of the shadow mask 10 can be easily obtained when Rd satisfies a predetermined range in association with Rx and Ry. Thus, it is necessary to set Rd to an appropriate range. Therefore, it is preferred that the shadow mask 10 satisfies the following condition: 0<Rd<3000 mm or the following condition: Rd<−1500 mm.

Subsequently, as shown in Tables 1 to 6, it is preferred that the cathode ray tube is constructed such that the shadow mask satisfies the following condition: Rx<1200 mm or Ry<1200 mm and the following condition of 0<Rd<3000 mm or Rd<−1500 mm. More preferably, the shadow mask 10 is constructed to satisfy the following condition: Rx<1000 mm or Ry<1000 mm.

Meanwhile, the shadow mask 10 is generally made of AK material or invar material. The unit price of the shadow mask 10 of the AK material is relatively low but relatively disadvantageous in strength characteristic and doming characteristic. If the shadow mask 10 is constructed to satisfy the aforementioned ranges of Rx, Ry and Rd, this definitely supplements the strength characteristic and doming characteristic, and thus its effect is more remarkable.

Although the color cathode ray tube according to the present invention has been described with reference to the illustrated drawings, the INVENTION is not limited to the embodiments and drawings disclosed in the specification and the technical spirit of the present invention for improving deterioration of the quality of a shadow mask according to an increase of a deflection angle by optimally designing the shadow mask can be easily applied by those skilled in the art within the scope of protection.

The operational effects of the cathode ray tube thus-constructed in accordance with the present invention will be described below.

The cathode ray tube in accordance with the present invention is constructed in such a manner that as the deflection angle of the electron beam is increased to more than 120 degrees, the shadow mask satisfies the following condition: Rx<1200 mm or Ry<1200 mm and satisfies the following condition: 0<Rd<3000 mm or Rd<−1500. The structural strength of the shadow mask is increased, thereby improving thermal distortion and vibration problems and preventing mislanding of the electron beam caused by doming and a screen distortion caused by an inner pin distortion.

What is claimed is:

1. A cathode ray tube, which comprises a shadow mask between an electron gun and a screen and, which has a deflection angle of 120 degrees of an electron beam directed toward a screen from the electron gun, wherein the shadow mask satisfies the following condition: Ry<1200 mm where Ry is a radius of curvature of the end in the direction of a short axis of an effective surface of the shadow mask.

2. The cathode ray tube as claimed in claim 1, wherein the shadow mask satisfies the following condition: Ry<1000 mm.

3. The cathode ray tube as claimed in claim 1, wherein the shadow mask satisfies the following condition: Rx<1200 mm where Rx is a radius of curvature of the end in the direction of a long axis of an effective surface of the shadow mask.

4. The cathode ray tube as claimed in claim 1, wherein the shadow mask satisfies the following condition: Rx<1000 mm.

5. The cathode ray tube as claimed in claim 1, wherein the shadow mask satisfies the following condition: 0<Rd<3000 mm where Rd is a radius of curvature of the end in the direction of a diagonal axis of an effective surface of the shadow mask.

6. The cathode ray tube as claimed in claim 1, wherein the shadow mask satisfies the following condition: Rd<−1500 mm where Rd is a radius of curvature of the end in the direction of a diagonal axis of an effective surface of the shadow mask.

7. The cathode ray tube as claimed in claim 1, wherein the shadow mask satisfies the following condition: Rx>1200 mm and the following condition: 0<Rd<3000 mm where Rx is a radius of curvature of the end in the direction of a long axis of an effective surface of the shadow mask and Rd is a radius of curvature of the end in the direction of a diagonal axis of an effective surface of the shadow mask.

8. The cathode ray tube as claimed in claim 1, wherein the shadow mask satisfies the following condition: Ry<1000 mm and Rx<1200 mm and the following condition: 0<Rd<3000 mm where Rx is a radius of curvature of the end in the direction of a long axis of an effective surface of the shadow mask and Rd is a radius of curvature of the end in the direction of a diagonal axis of an effective surface of the shadow mask.

9. A cathode ray tube, which comprises a shadow mask between an electron gun and a screen and, which has a deflection angle of 120 degrees of an electron beam directed toward a screen from the electron gun, wherein the shadow mask satisfies the following condition: Rx<1200 mm where Rx is a radius of curvature of the end in the direction of a long axis of an effective surface of the shadow mask.

10. The cathode ray tube as claimed in claim 9, wherein the shadow mask satisfies the following condition: Ry<1000 mm where Ry is a radius of curvature of the end in the direction of a short axis of an effective surface of the shadow mask.

11. The cathode ray tube as claimed in claim 9, wherein the shadow mask satisfies the following condition: Rd<−1500 mm where Rd is a radius of curvature of the end in the direction of a diagonal axis of an effective surface of the shadow mask.

12. A cathode ray tube, which comprises a panel whose outer surface is substantially flat and whose inner surface has a predetermined curvature; a funnel coupled with the panel; an electron gun inserted into the funnel, for discharging an electron beam toward a screen; and a shadow mask disposed between the electron gun and the screen, wherein the shadow mask satisfies the following condition: Ry<1200 mm where Ry is a radius of curvature of the end in the direction of a short axis of an effective surface of the shadow mask, and wherein the cathode ray tube has a deflection angle of 120 degrees of the electron beam.

13. The cathode ray tube as claimed in claim 12, wherein the shadow mask satisfies the following condition: Ry<1000 mm.

14. The cathode ray tube as claimed in claim 12, wherein the shadow mask satisfies the following condition: Rx<1200 mm where Rx is a radius of curvature of the end in the direction of a long axis of an effective surface of the shadow mask.

15. The cathode ray tube as claimed in claim 12, wherein the shadow mask satisfies the following condition: Rx<1000 mm.

16. The cathode ray tube as claimed in claim 12, wherein the shadow mask satisfies the following condition: Rd<−1500 mm where Rd is a radius of curvature of the end in the direction of a diagonal axis of an effective surface of the shadow mask.

17. A cathode ray tube, which comprises a panel whose outer surface is substantially flat and whose inner surface has a predetermined curvature; a funnel coupled with the panel; an electron gun inserted into the funnel, for discharging an electron beam toward a screen; and a shadow mask disposed between the electron gun and the screen, wherein the shadow mask satisfies the following condition: Rx<1200 mm where Rx is a radius of curvature of the end in the direction of a long axis of an effective surface of the shadow mask, and wherein the cathode ray tube has a deflection angle of 120 degrees of the electron beam.

18. The cathode ray tube as claimed in claim 17, wherein the shadow mask satisfies the following condition: Rx<1000 mm.

* * * * *